US010654675B1

(12) United States Patent
Chen et al.

(10) Patent No.: US 10,654,675 B1
(45) Date of Patent: May 19, 2020

(54) SLIDING DEVICE FOR MATERIAL SHAFT

(71) Applicant: YUNG YI LI CO., LTD., Taichung (TW)

(72) Inventors: Xi-Cai Chen, Taichung (TW); Guan-Min Chen, Taichung (TW)

(73) Assignee: YUNG YI LI CO., LTD., Taichung (TW)

( * ) Notice: Subject to any disclaimer, the term of this patent is extended or adjusted under 35 U.S.C. 154(b) by 0 days.

(21) Appl. No.: 16/248,047

(22) Filed: Jan. 15, 2019

(51) Int. Cl.
*B65H 19/30* (2006.01)

(52) U.S. Cl.
CPC ..... *B65H 19/305* (2013.01); *B65H 2402/32* (2013.01); *B65H 2402/521* (2013.01); *B65H 2402/531* (2013.01); *B65H 2405/45* (2013.01); *B65H 2601/31* (2013.01)

(58) Field of Classification Search
CPC .. B65H 19/30; B65H 19/305; B65H 19/2292; B65H 2402/32
See application file for complete search history.

(56) References Cited

U.S. PATENT DOCUMENTS 3,006,565 A * 10/1961 Pelletier ..... D01H 7/16 242/571.7
7,128,291 B1 * 10/2006 Schanke ..... B65H 19/305 242/533.7
8,910,899 B2 * 12/2014 Miyamoto ..... B65H 75/242 242/571
2013/0272766 A1 * 10/2013 Tanaka ..... B65H 75/245 400/242

* cited by examiner

*Primary Examiner* — Sang K Kim
(74) *Attorney, Agent, or Firm* — Pai Patent & Trademark Law Firm; Chao-Chang David Pai

(57) ABSTRACT

A sliding device for a material shaft includes a shaft body, sliding units, spacers. An outer periphery of the shaft body has axial accommodating grooves. The sliding units and the spacers are spaced and arranged in the accommodating grooves. A top surface of each roller extends out of the outer periphery of the shaft body. When a material roll is sleeved on the shaft body, the inner wall of the material roll is in contact with the outer periphery of the rollers. When the material roll is to be mounted on or dismounted from the shaft body, the material roll is pushed in a direction so that the inner wall of the material roll rubs against the rollers, thereby rotating the rollers. The friction between the material roll and the shaft body is reduced for the material roll to be mounted on or dismounted from the shaft body effortlessly.

5 Claims, 6 Drawing Sheets

SLIDING DEVICE FOR MATERIAL SHAFT

FIELD OF THE INVENTION

The present invention relates to a sliding device, and more particularly to a sliding device for a material shaft.

BACKGROUND OF THE INVENTION

A rotary processing machine is widely used in material coiling equipment for plastic film, metal foil, paper roll, steel roll and the like. The manufactured material is wound into a material roll, and the material roll is placed on a material discharging shaft for cutting. After that, the cut material is re-wound evenly on a winding shaft to form a material roll, thereby completing the cutting operation for the material. Then, the material roll on the winding shaft is removed and placed on a material receiving shaft for subsequent distribution and storage.

However, due to the social development in these days, the operators who operate machines are mostly women. Besides, the material is quite heavy. Therefore, when the uncut material roll is placed on the material discharging shaft, or when the material roll is removed from the winding shaft and the material roll is placed on the material receiving shaft, it is more laborious. In the process of dismounting or mounting the material roll, it is easy to cause physical injury to the operator. Accordingly, the inventor of the present invention has devoted himself based on his many years of practical experiences to solve these problems.

SUMMARY OF THE INVENTION

The primary object of the present invention is to provide a sliding device for a material shaft. The sliding device is simple in structure and convenient for installation, so that a material roll can be mounted or dismounted from the material shaft effortlessly.

In order to achieve the aforesaid object, the present invention provides a sliding device for a material shaft. The sliding device comprises a shaft body, a plurality of sliding units, and a plurality of spacers. An outer periphery of the shaft body has an annular sleeve surface. The annular sleeve surface is provided with a plurality of parallel accommodating grooves extending axially. Either side of an inner wall of each accommodating groove is recessed with a limiting groove extending axially. The sliding units are disposed in the accommodating grooves. Each sliding unit includes at least one limiting rod and two rollers. The limiting rod has a limiting portion extending in an axial direction of the shaft body. The limiting portion is located in the limiting groove. Two ends of the limiting portion are provided with pivot portions extending radially. The pivot portions are pivotally connected to the rollers, respectively. The rollers are located in each accommodating groove. A top surface of each roller extends out of the annular sleeve surface of the shaft body. Distal ends of each pivot portion have engaging ends. The spacers are disposed in the accommodating grooves. The spacers are spaced and arranged between the sliding units, respectively. Each spacer has a positioning portion. Two ends of the positioning portion are provided with abutting portions extending radially. Distal ends of each abutting portion have engaging ends. The engaging ends of the spacers lean against the engaging ends of the adjacent limiting rod to limit the rollers.

In the sliding device for a material shaft provided by the present invention, the top end of each roller extends out of the annular sleeve surface of the shaft body, so that when a material roll is sleeved on the shaft body, the inner wall of the material roll is in contact with the rollers. When the material shaft is rotated, the inner wall of the material roll rubs against the rollers to rotate the rollers so as to reduce the friction between the material roll and the shaft body. In this way, the material roll can be mounted on or dismounted from the shaft body effortlessly.

DETAILED DESCRIPTION OF THE PREFERRED EMBODIMENTS

Embodiments of the present invention will now be described, by way of example only, with reference to the accompanying drawings.

Figure 1:
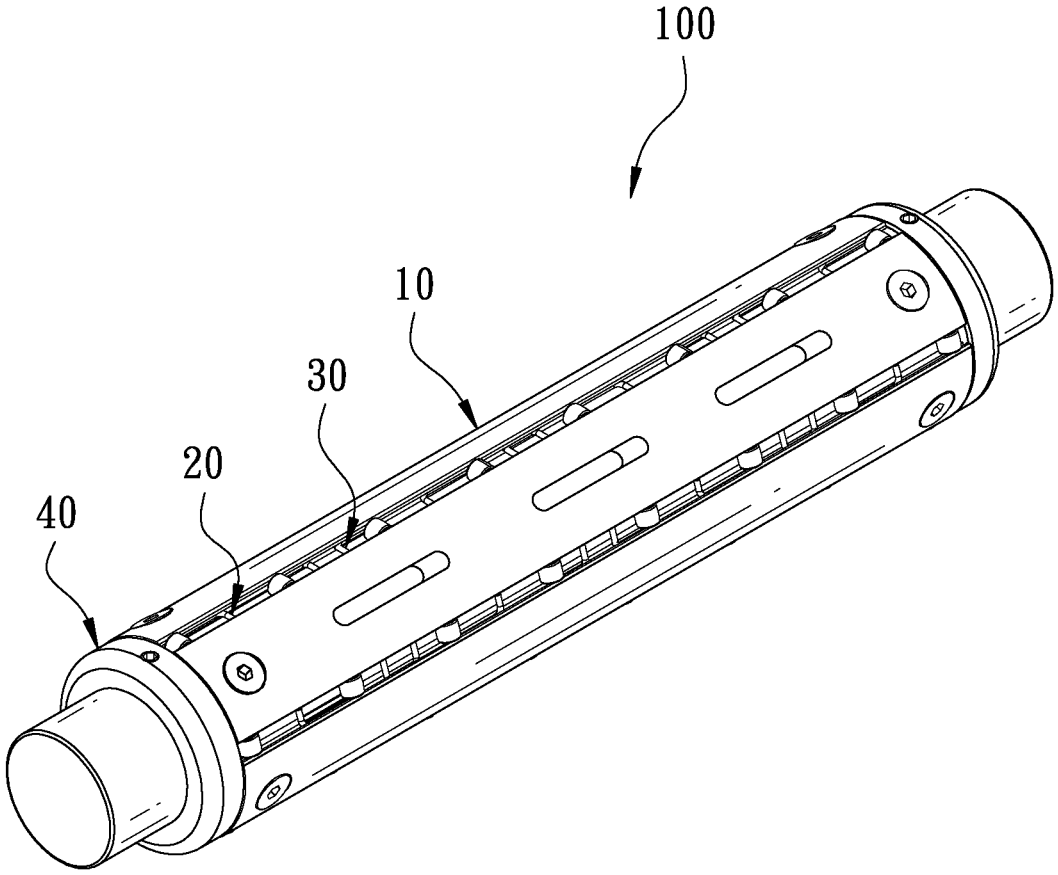
FIG. 1 is a perspective view of a preferred embodiment of the present invention.
Figure 2:
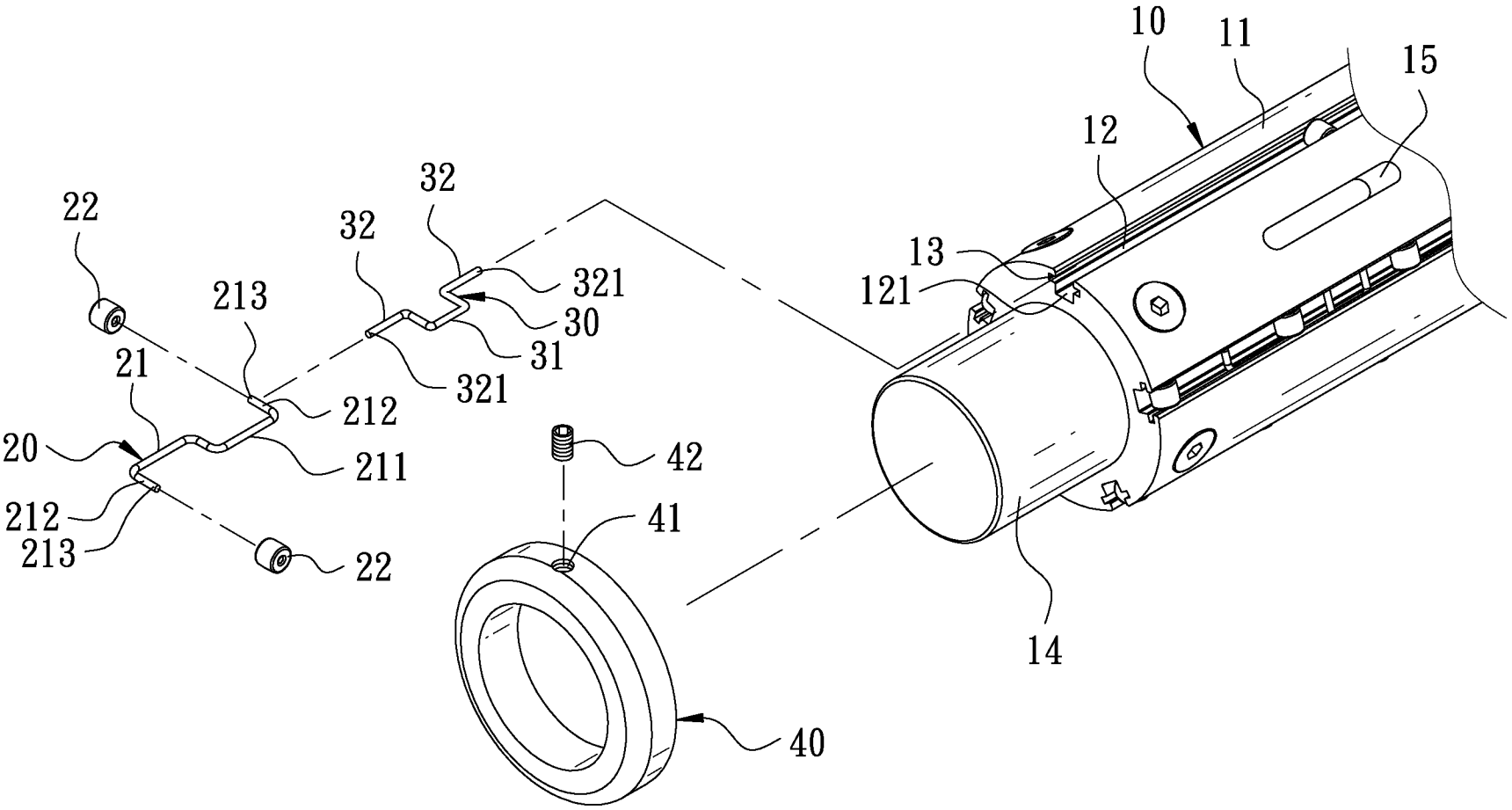
FIG. 2 is an exploded view of the preferred embodiment of the present invention.
Figure 3:
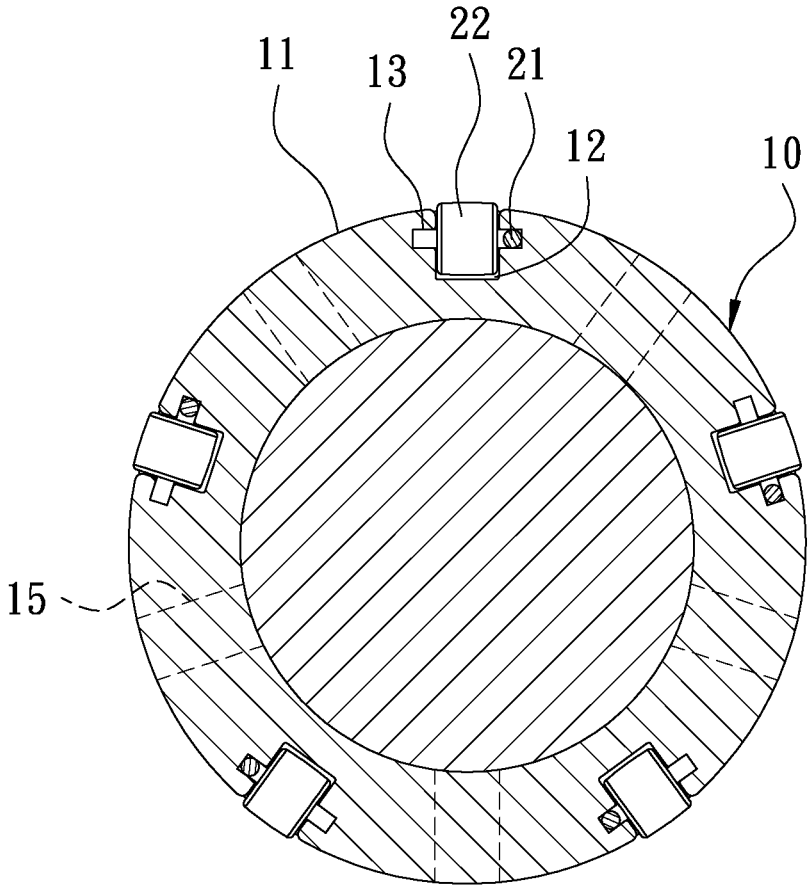
FIG. 3 is a longitudinal cross-sectional view of the preferred embodiment of the present invention.

FIG. 1 is a perspective view of a preferred embodiment of the present invention. FIG. 2 is an exploded view of the preferred embodiment of the present invention. FIG. 3 is a longitudinal cross-sectional view of the preferred embodiment of the present invention. The invention discloses a sliding device 100 for a material shaft. The sliding device 100 comprises a shaft body 10, a plurality of sliding units 20, a plurality of spacers 30, and two stop rings 40.

The shaft body 10 is a cylinder having a predetermined length. The outer periphery of the shaft body 10 has an annular sleeve surface 11. The annular sleeve surface 11 is provided with a plurality of parallel accommodating grooves 12 extending axially. Either end of each accommodating groove 12 has an opening 121. Two sides of the inner wall of the accommodating groove 12 are recessed with limiting grooves 13 extending axially. Two ends of the shaft body 10 have connecting flanges 14. In this embodiment, the shaft body 10 may be one of a material discharging shaft or a material receiving shaft. The outer periphery of the shaft body 10 is provided with a plurality of slots 15 extending axially. In addition to reducing the weight of the shaft body 10, the slots 15 may be used for receiving other functional parts.

Figure 4:
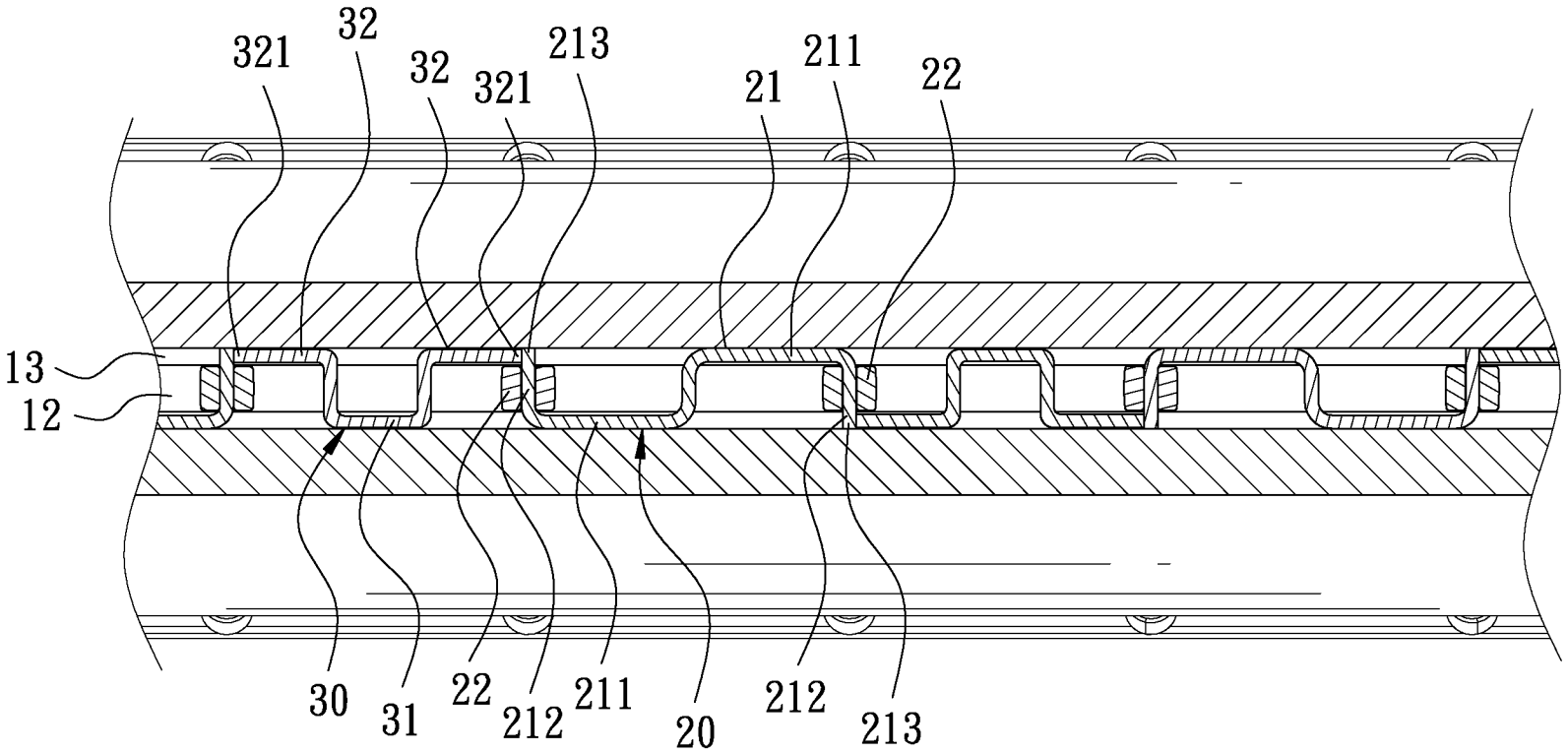
FIG. 4 is a transverse cross-sectional view of the preferred embodiment of the present invention.

The sliding units 20 are disposed in the accommodating grooves 12 of the shaft body 10. Each sliding unit 20 includes a limiting rod 21 and two rollers 22. As shown in FIG. 4, the limiting rod 21 has a limiting portion 211 extending in the axial direction of the shaft body 10. The limiting portion 211 is located in the two limiting grooves 13. In this embodiment, the limiting portion 211 is S-shaped. Two ends of the limiting portion 211 are provided with pivot portions 212 extending radially, respectively. The pivot portions 212 are pivotally connected to the rollers 22, respectively. The rollers 22 are located in the accommodating groove 12. The top surface of each roller 22 extends out of the annular sleeve surface 11 of the shaft body 10. Distal ends of each of the pivot portions 212 have engaging ends 213.

The spacers 30 are disposed in the accommodating grooves 12 of the shaft body 10. The spacers 30 are spaced and arranged between the sliding units 20, respectively. As shown in FIG. 4, in this embodiment, each spacer 30 has a positioning portion 31. The positioning portion 31 is U-shaped. The positioning portion 31 is disposed in the limiting groove 13. Two ends of the positioning portion 31 are provided with abutting portions 32 extending radially, respectively. Distal ends of each of the abutting portions 32 have engaging ends 321. The engaging ends 321 lean against the engaging ends 213 of the adjacent limiting rod 21 to limit the rollers 22.

The stop rings 40 are disposed on the connecting flanges 14 of the shaft body 10, respectively. The stop rings 40 are attached to two sides of the shaft body 10 to close the openings 121 of the accommodating grooves 12, so that the sliding units 20 and the spacers 30 are confined in the accommodating grooves 12 of the shaft body 10. The stop rings 40 each have at least one screw hole 41. A bolt 42 is screwed to the screw hole 41 for fixing the stop rings 40 to the connecting flanges 14.

FIG. 4 is a cross-sectional view of the preferred embodiment of the present invention. When the sliding device 100 is to be installed, the rollers 22 are first sleeved on the pivot portions 212 of the limiting rod 21, and the pivot portions 212 pass through the opening 121 of the accommodating groove 12, so that the sliding units 20 are disposed in accommodating groove 12. The spacers 30 are spaced and arranged between the sliding units 20, such that the engaging ends 321 of the spacers 30 abut against the engaging ends 213 of the adjacent limiting rod 21 to limit the rollers 22. The rollers 22 are just located in the accommodating grooves 12. Then, the stop rings 40 are disposed on the connecting flanges 14, respectively. The stop rings 40 are locked by the bolts 42 to close the openings 121 of the accommodating grooves 12, so that the sliding units 20 and the spacers 30 are confined in the accommodating grooves 12 to complete the installation. The sliding device 100 has a simple structure and can be installed conveniently.

Figure 5:
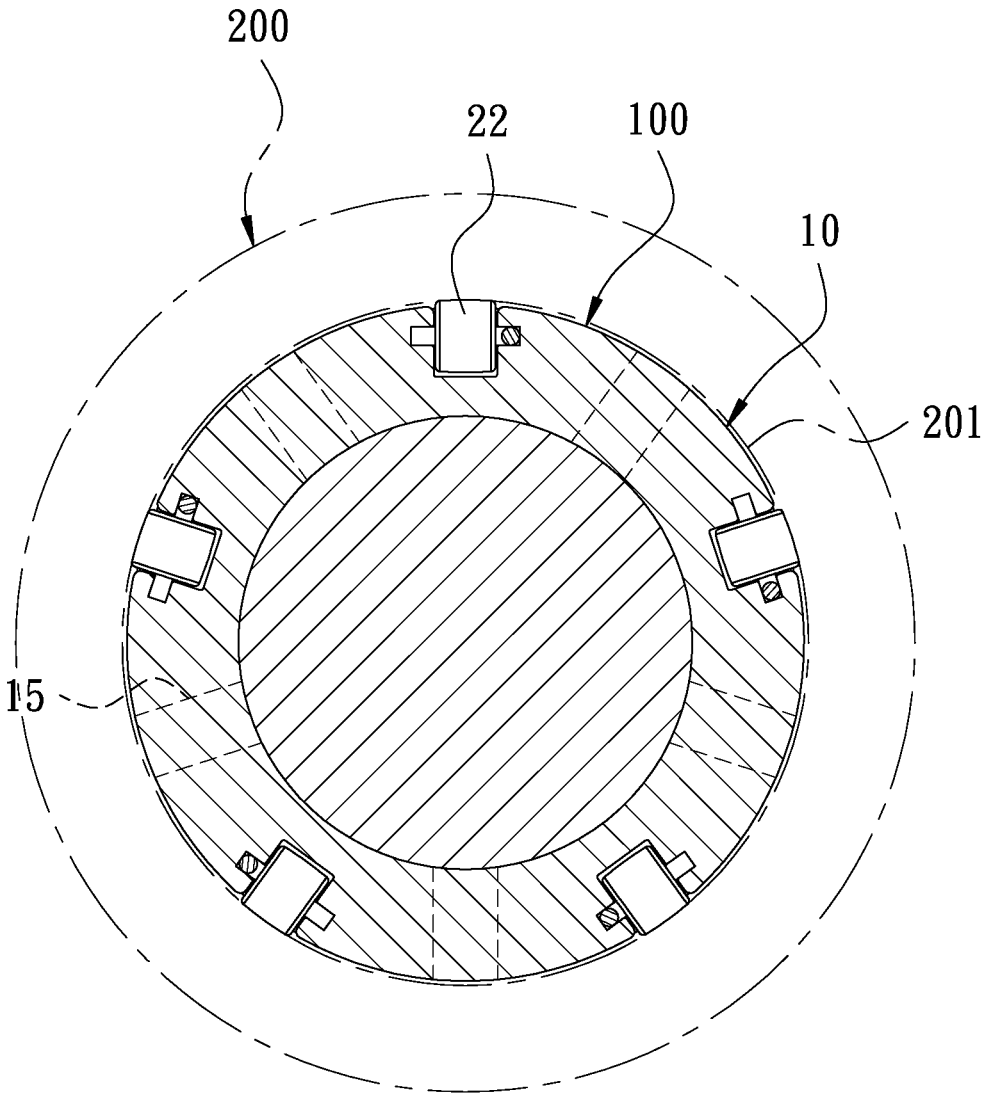
FIG. 5 is a schematic view of the preferred embodiment of the present invention.

FIG. 5 is a schematic view of the present invention when in use. When a material roll 200 is sleeved on the shaft body 10, the outer periphery of the upper end of each roller 22 is in contact with the inner wall 201 of the material roll 200. When the material roll 200 slides on the shaft body 10, the inner wall 201 of the material roll 200 rubs against the rollers 22 to rotate the rollers 22. In this way, the material roll 200 is pushed effortlessly. When the material roll 200 is removed from the shaft body 10, the material roll 200 is pushed in the axial direction of the shaft body 10, and the inner wall 201 of the material roll 200 rubs against the rollers 22 to rotate the rollers 22. Thereby, through the inner wall 201 of the material roll 200 to rub against the rollers 22 to rotate the rollers 22, the friction between the material roll 200 and the shaft body 10 is reduced so that the operator can mount or dismount the material roll 200 from the shaft body 10 effortlessly.

Figure 6:
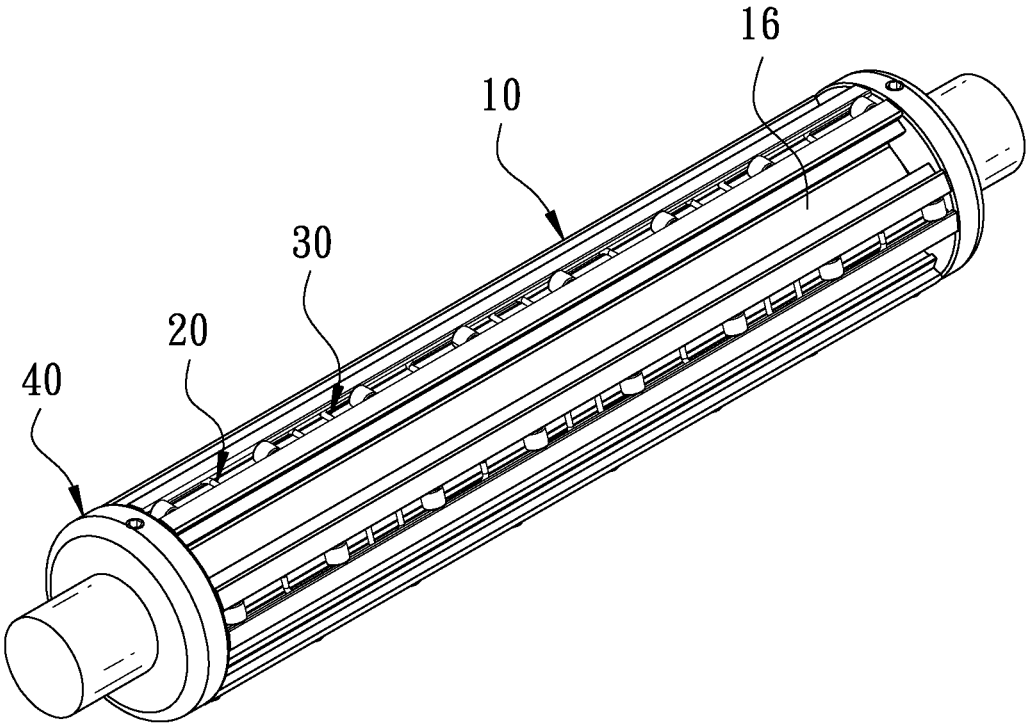
FIG. 6 is a perspective view of another embodiment of the present invention.

FIG. 6 is a perspective view of another embodiment of the present invention. In this embodiment, the outer periphery of the shaft body 10 is provided with a plurality of parallel grooves 16 extending axially. The grooves 16 may be provided with a device for holding the material roll 200 to form a winding shaft for clamping the material roll 200, thereby enabling the sliding device 100 of the present invention to be applied to different material shafts.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A sliding device for a material shaft, comprising:

a shaft body, an outer periphery of the shaft body having an annular sleeve surface, the annular sleeve surface being provided with a plurality of parallel accommodating grooves extending axially, either side of an inner wall of each of the accommodating grooves being recessed with a limiting groove extending axially;

a plurality of sliding units, disposed in the accommodating grooves, each of the sliding units including at least one limiting rod and two rollers, the limiting rod having a limiting portion extending along an axial direction of the shaft body, the limiting portion being located in the limiting groove, two ends of the limiting portion being provided with pivot portions extending radially, the pivot portions being pivotally connected to the rollers respectively, the rollers being located in each of the accommodating grooves, a top surface of each of the rollers extending out of the annular sleeve surface of the shaft body, distal ends of each of the pivot portions having engaging ends;

a plurality of spacers, disposed in the accommodating grooves, the spacers being spaced and arranged between the sliding units respectively, each of the spacers having a positioning portion, two ends of the positioning portion being provided with abutting portions extending radially, distal ends of each of the abutting portions having engaging ends, the engaging ends of the spacers leaning against the engaging ends of the adjacent limiting rod to limit the rollers.

2. The sliding device as claimed in claim 1, wherein the positioning portion is U-shaped.

3. The sliding device as claimed in claim 1, wherein either end of each of the accommodating grooves has an opening so that the sliding units and the spacers are inserted in the accommodating grooves via the openings of the accommodating grooves.

4. The sliding device as claimed in claim 3, wherein two ends of the shaft body have connecting flanges, the connecting flanges are sleeved with stop rings respectively, and the stop rings are attached to two sides of the shaft body to close the openings of the accommodating grooves.

5. The sliding device as claimed in claim 1, wherein the limiting portion of the limiting rod is S-shaped.

* * * * *